US007438772B2

(12) United States Patent
Rioja et al.

(10) Patent No.: US 7,438,772 B2
(45) **Date of Patent: *Oct. 21, 2008**

(54) ALUMINUM-COPPER-MAGNESIUM ALLOYS HAVING ANCILLARY ADDITIONS OF LITHIUM

(75) Inventors: Roberto J. Rioja, Alcoa Center, PA (US); Gary H. Bray, Alcoa Center, PA (US); Paul E. Magnusen, Alcoa Center, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/678,290

(22) Filed: Oct. 3, 2003

(65) Prior Publication Data

US 2004/0071586 A1 Apr. 15, 2004

Related U.S. Application Data

(63) Continuation-in-part of application No. 09/104,123, filed on Jun. 24, 1998, now abandoned.

(51) Int. Cl.
*C22C 21/12* (2006.01)

(52) U.S. Cl. ..... 148/417; 420/533; 420/535; 420/539

(58) Field of Classification Search ..... 148/417; 420/533, 539, 535, 532, 552
See application file for complete search history.

(56) References Cited

U.S. PATENT DOCUMENTS

| | | | | |
|---|---|---|---|---|
| 4,648,913 | A | 3/1987 | Hunt, Jr. et al. | 148/12.7 A |
| 4,790,884 | A | 12/1988 | Young et al. | 148/2 |
| 4,806,174 | A | 2/1989 | Cho et al. | 148/12.7 A |
| 4,832,910 | A | 5/1989 | Rioja et al. | 420/528 |
| 4,848,647 | A | 7/1989 | Gentry et al. | 228/263.17 |
| 4,869,870 | A | 9/1989 | Rioja et al. | 420/532 |
| 5,032,359 | A | 7/1991 | Pickens et al. | 420/533 |
| 5,076,859 | A | 12/1991 | Rioja et al. | 148/12.7 A |
| 5,122,339 | A | 6/1992 | Pickens et al. | 420/533 |
| 5,137,686 | A | 8/1992 | Rioja et al. | 420/528 |
| 5,211,910 | A | 5/1993 | Pickens et al. | 420/532 |

(Continued)

FOREIGN PATENT DOCUMENTS

DE 2810932 10/1978

(Continued)

OTHER PUBLICATIONS

Aluminum Association, Inc., "Registration Record of Aluminum Association Designations and Chemical Composition Limits for Wrought Aluminum and Wrought Aluminum Alloys", Revised Jan. 1989, pp. 1-15, Washingotn, D.C.

*Primary Examiner*—Roy King
*Assistant Examiner*—Janelle Morillo
(74) *Attorney, Agent, or Firm*—Greenberg Traurig, LLP

(57) ABSTRACT

An aluminum-copper-magnesium alloy having ancillary additions of lithium. The alloy composition includes from about 3 to about 5 weight percent Cu, from about 0.5 to about 2 weight percent Mg, and from about 0.01 to about 0.9 weight percent Li. The combined amount of Cu and Mg is maintained below a solubility limit of the aluminum alloy. The alloys possess improved combinations of fracture toughness and strength, and also exhibit good fatigue crack growth resistance.

20 Claims, 14 Drawing Sheets

U.S. PATENT DOCUMENTS

| | | | | |
|---|---|---|---|---|
| 5,221,377 | A | 6/1993 | Hunt, Jr. et al. | 148/417 |
| 5,259,897 | A | 11/1993 | Pickens et al. | 148/417 |
| 5,455,003 | A | 10/1995 | Pickens et al. | 420/529 |
| 5,462,712 | A | 10/1995 | Langan et al. | 420/528 |
| 5,496,426 | A | 3/1996 | Murtha | 148/691 |
| 5,512,241 | A | 4/1996 | Kramer et al. | 420/528 |
| 5,624,632 | A | 4/1997 | Baumann et al. | 420/544 |
| 5,667,602 | A | 9/1997 | Fang et al. | 148/549 |
| 5,863,359 | A | 1/1999 | Karabin et al. | 148/437 |
| 5,865,911 | A | 2/1999 | Miyasato et al. | 148/439 |
| 5,865,914 | A | 2/1999 | Karabin et al. | 148/693 |
| 6,277,219 | B1 | 8/2001 | Heinz et al. | 148/552 |
| 6,562,154 | B1 * | 5/2003 | Rioja et al. | 148/415 |
| 7,229,509 | B2 * | 6/2007 | Cho | 148/417 |

FOREIGN PATENT DOCUMENTS

| | | |
|---|---|---|
| EP | 0 273 600 A2 | 7/1988 |
| JP | 01025954 | 1/1989 |
| WO | WO 92/12269 | 7/1992 |
| WO | WO 95/32074 | 11/1995 |

* cited by examiner

Composition Space Covering Al-Cu-Mg Alloys
With Ancillary Li Additions

ALUMINUM-COPPER-MAGNESIUM ALLOYS HAVING ANCILLARY ADDITIONS OF LITHIUM

CROSS-REFERENCE TO RELATED APPLICATION

This application is a continuation-in-part of U.S. application Ser. No. 09/104,123 filed Jun. 24, 1998, which is incorporated herein by reference.

FIELD OF THE INVENTION

The present invention relates to aluminum alloys useful in aerospace applications, and more particularly relates to aluminum-copper-magnesium alloys having ancillary additions of lithium which possess improved combinations of fracture toughness and strength, as well as improved fatigue crack growth resistance.

BACKGROUND OF THE INVENTION

It is generally well known in the aerospace industry that one of the most effective ways to reduce the weight of an aircraft is to reduce the density of aluminum alloys used in aircraft construction. This desire led to the addition of lithium, the lowest density metal element, to aluminum alloys. Aluminum Association alloys, such as 2090 and 2091 contain about 2.0 weight percent lithium, which translates into about a 7 percent weight savings over alloys containing no lithium. Aluminum alloys 2094 and 2095 contain about 1.2 weight percent lithium. Another aluminum alloy, 8090 contains about 2.5 weight percent lithium, which translates into an almost 10 percent weight savings over alloys without lithium.

However, casting of such conventional alloys containing relatively high amounts of lithium is difficult. Furthermore, the combined strength and fracture toughness of such alloys is not optimal. A tradeoff exists with conventional aluminum-lithium alloys in which fracture toughness decreases with increasing strength.

Another important characteristic of aerospace aluminum alloys is fatigue crack growth resistance. For example, in damage tolerant applications in aircraft, increased fatigue crack growth resistance is desirable. Better fatigue crack growth resistance means that cracks will grow slower, thus making airplanes much safer because small cracks can be detected before they achieve critical size for catastrophic propagation. Furthermore, slower crack growth can have an economic benefit due to the fact that longer inspection intervals can be utilized.

A need therefore exists for an aluminum alloy that is useful in aircraft application which has high fracture toughness, high strength and excellent fatigue crack growth resistance.

SUMMARY OF THE INVENTION

The present invention provides aluminum alloys comprising from about 3 to about 5 weight percent copper; from about 0.5 to about 2 weight percent magnesium; and from about 0.01 to about 0.9 weight percent lithium. It has been found that ancillary additions of low levels of lithium to aluminum alloys having controlled amounts of copper and magnesium provide a high fracture toughness and high strength material which also exhibits equivalent or improved fatigue crack growth resistance over prior art aluminum-copper-magnesium alloys. An aspect of the present invention is to provide an aluminum alloy comprising from about 3 to about 5 weight percent Cu, from about 0.5 to about 2 weight percent Mg, and from about 0.01 to about 0.9 weight percent Li, wherein the Cu and Mg are present in the alloy in a total amount below a solubility limit of the alloy.

This and other aspects of the present invention will be more apparent from the following description.

DETAILED DESCRIPTION

Figure 1:
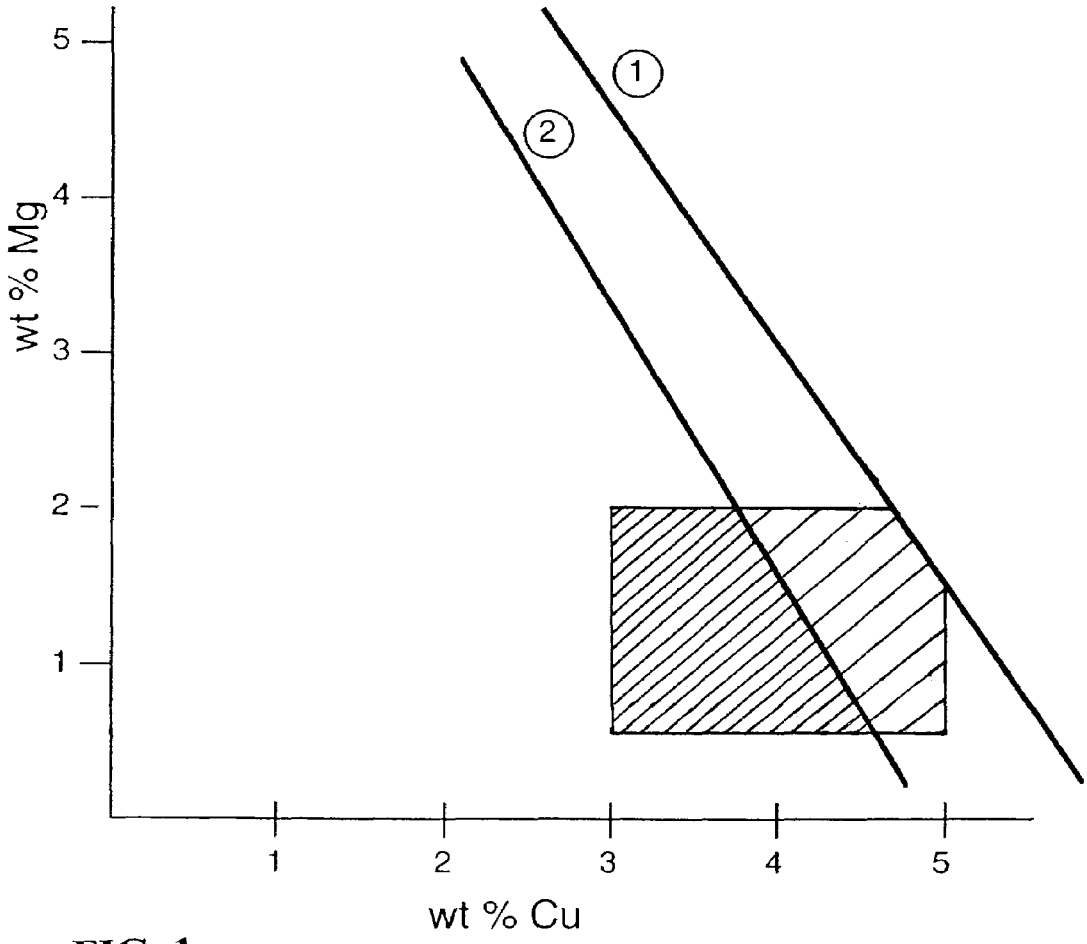
FIG. 1 is a graph of Mg content versus Cu content, illustrating maximum limits of those elements for Al—Cu—Mg—Li alloys in accordance with embodiments of the present invention.

For the description of alloy compositions herein, all references are to weight percentages unless otherwise indicated. When referring to any numerical range of values, such ranges are to be understood to include each and every number and/or fraction between the stated range minimum and maximum.

As used herein, the term "about" when used to describe a compositional range or amount of an alloying addition means that the actual amount of the alloying addition may vary from the nominal intended amount due to factors such as standard processing variations as understood by those skilled in the art.

The term "substantially free" means having no significant amount of that component purposely added to the alloy composition, it being understood that trace amounts of incidental elements and/or impurities may find their way into a desired end product.

The term "solubility limit" means the maximum amount of alloying additions that can be made to the aluminum alloy while remaining as a solid solution in the alloy at a given temperature. For example, the solubility limit for the combined amount of Cu and Mg is the point at which the Cu and/or Mg no longer remain as a solid solution in the aluminum alloy at a given temperature. The temperature may be chosen to represent a practical compromise between thermodynamic phase diagram data and furnace controls in a manufacturing environment.

The term "improved combination of fracture toughness and strength" means that the present alloys either possess higher fracture toughness and equivalent or higher strength, or possess higher strength and equivalent or higher fracture toughness, in at least one temper in comparison with similar alloys having no lithium or greater amounts of lithium.

As used herein, the term "damage tolerant aircraft part" means any aircraft or aerospace part which is designed to ensure that its crack growth life is greater than any accumulation of service loads which could drive a crack to a critical size resulting in catastrophic failure. Damage tolerance design is used for most of the primary structure in a transport category airframe, including but not limited to fuselage panels, wings, wing boxes, horizontal and vertical stabilizers, pressure bulkheads, and door and window frames. In inspectable areas, damage tolerance is typically achieved by redundant designs for which the inspection intervals are set to provide at least two inspections per number of flights or flight hours it would take a visually detectable crack to grow to its critical size.

The present invention relates to aluminum-copper-magnesium alloys having ancillary additions of lithium. In accordance with the invention, wrought aluminum-copper-magnesium alloys are provided which have improved combinations of fracture toughness and strength over prior art aluminum-copper-magnesium alloys. The present alloys also possess improved fatigue crack growth resistance. The alloys of the present invention are especially useful for aircraft parts requiring high damage tolerance, such as lower wing components including thin plate for skins and extrusions for stringers for use in built-up structure, or thicker plate or extrusions for stiffened panels for use in integral structure; fuselage components including sheet and thin plate for skins, extrusions for stringers and frames, for use in built-up, integral or welded designs. They may also be useful for spar and rib components including thin and thick plate and extrusions for built-up or integral design or for empennage components including those from sheet, plate and extrusion, as well as aircraft components made from forgings including aircraft wheels, spars and landing gear components. The strength capabilities of the alloys are such that they may also be useful for upper wing components and other applications where aluminum-copper-magnesium-zinc alloys are typically employed. The addition of low levels of lithium avoids problems associated with higher (i.e., over 1.5 weight percent lithium) additions of lithium, such as explosions of the molten metal during the casting of ingots.

In accordance with embodiments of the present invention, the aluminum alloy may be provided in the form of sheet or plate. Sheet products include rolled aluminum products having thicknesses of from about 0.006 to about 0.25 inch. The thickness of the sheet is preferably from about 0.025 to about 0.25 inch, more preferably from about 0.05 to about 0.25 inch. For many applications such as some aircraft fuselages, the sheet is preferably from about 0.05 to about 0.25 inch thick, more preferably from about 0.05 to about 0.2 inch. Plate products include rolled aluminum products having thicknesses of from about 0.25 to about 8 inch. For wing applications, the plate is typically from about 0.50 to about 4 inch. In addition, light gauge plate ranging from 0.25 to 0.50 inch is also used in fuselage applications. The sheet and light gauge plate may be unclad or clad, with preferred cladding layer thicknesses of from about 1 to about 5 percent of the thickness of the sheet or plate. In addition to sheet and plate products, the present alloys may be fabricated as other types of wrought products, such as extrusion and forgings by conventional techniques.

The compositional ranges of the main alloying elements (copper, magnesium and lithium) of the improved alloys of the invention are listed in Table 1.

TABLE 1

Copper, Magnesium and Lithium Compositional Ranges

| | Cu | Mg | Li | Al |
|---|---|---|---|---|
| Typical | 3-5 | 0.5-2 | 0.01-0.9 | balance |
| Preferred | 3.5-4.5 | 0.6-1.5 | 0.1-0.8 | balance |
| More Preferred | 3.6-4.4 | 0.7-1 | 0.2-0.7 | balance |

Copper is added to increase the strength of the aluminum base alloy. Care must be taken, however, to not add too much copper since the corrosion resistance can be reduced. Also, copper additions beyond maximum solubility can lead to low fracture toughness and low damage tolerance.

Magnesium is added to provide strength and reduce density. Care should be taken, however, to not add too much magnesium since magnesium additions beyond maximum solubility will lead to low fracture toughness and low damage tolerance.

In accordance with the present invention, the total amount of Cu and Mg added to the alloy is kept below the solubility limits shown in FIG. 1. In FIG. 1, the typical Cu and Mg compositional ranges listed in Table 1 are shown with a first solubility limit (1), and a second solubility limit (2), for the combination of Cu and Mg contained in the alloy. The solubility limit may decrease, e.g., from the first (1) to the second (2) solubility limit, as the amount of other alloying additions is increased. For example, additions of Li, Ag and/or Zn may tend to lower the solubility limit of Cu and Mg.

In order to remain below the solubility limit, the amount of Cu and Mg should conform to the formula: $Cu \leqq 2-0.676\ (Mg-6)$. Preferably, the amount of Cu and Mg conforms to the formula: $Cu \leqq 1.5-0.556\ (Mg-6)$ when about 0.8 wt % Li is added.

The amounts of copper and magnesium are thus controlled such that they are soluble in the alloy. This is important in that atoms of the alloying elements in solid solution or which form clusters of atoms of solute may translate to increased fatigue crack growth resistance. Furthermore, the combination of copper, magnesium and lithium needs to be controlled as to not exceed maximum solubility.

Within the controlled copper and magnesium ranges, the range of the lithium content may be from about 0.01 to 0.9 weight percent, preferably from about 0.1 or 0.2 weight percent up to about 0.7 or 0.8 weight percent. In accordance with the present invention, relatively small amounts of lithium have been found to significantly increase fracture toughness and strength of the alloys as well as provided increased fatigue crack growth resistance and decreased density. However, at lithium levels above the present levels, fracture toughness decreases significantly. Furthermore, care should be taken in not adding too much lithium since exceeding the maximum solubility will lead to low fracture toughness and low damage tolerances. Lithium additions in amounts of about 1.5 weight percent and above result in the formation of the δ' ("delta prime") phase with composition of $Al_3Li$. The presence of this phase, $Al_3Li$, is to be avoided in the alloys of the present invention.

While not intending to be bound by any particular theory, the interaction of lithium atoms in supersaturated solid solution, with atoms of magnesium and/or copper appear to give rise to the formation of clusters of atoms of solute in a W or T3 tempers. This behavior is observed by the appearance of diffuse scatter in electron diffraction images. This behavior may be a contributor for the improvements in fatigue performance of the alloys of the invention.

In addition to aluminum, copper, magnesium and lithium, the alloys of the present invention can contain at least one dispersoid-forming element selected from chromium, vanadium, titanium, zirconium, manganese, nickel, iron, hafnium, scandium and rare earths in a total amount of from about 0.05 to about 1 weight percent. For example, manganese may be present in a preferred amount of from about 0.2 to about 0.7 weight percent.

Other alloying elements, such as zinc, silver and/or silicon in amounts up to about 2 weight percent may optionally be added. For example, zinc in an amount of from about 0.05 to about 2 weight percent may be added, typically from about 0.2 to about 1 weight percent. As a particular example, zinc in an amount of 0.5 weight percent may be added. When zinc is added to the alloy, it may serve as a partial or total replacement for magnesium.

Silver in an amount of from about 0.01 to about 2 weight percent may be added, typically from about 0.05 to about 0.6 weight percent. For example, silver in an amount of from about 0.1 to about 0.4 weight percent may be added.

Silicon in an amount of from about 0.1 to about 2 weight percent may be added, typically from about 0.3 to about 1 weight percent.

In accordance with embodiments of the present invention, certain elements may be excluded from the alloy compositions, i.e., the elements are not purposefully added to the alloys, but may be present as unintentional or unavoidable impurities. Thus, the alloys may be substantially free of elements such as Sc, Ag and/or Zn, if desired.

It has been found that the combination of lower copper levels, higher magnesium levels and lower levels of lithium produce an aluminum alloy that has increased fracture toughness and strength, superior fatigue crack growth resistance and relatively low density. Fracture toughness and strength are critical properties for aluminum alloys used in aircraft applications. Fatigue crack growth resistance is also a critical property for damage tolerant aircraft parts, such as fuselage sections and lower wing sections. As is known, these parts of an aircraft are subject to cyclical stresses, such as the fuselage skin which is expanded and contracted upon pressurization and depressurization of the aircraft cabin and the lower wing skin which experiences tensile stresses in flight and compressive stresses while the aircraft is on the ground. Improved fatigue crack growth resistance means cracks will grow and reach their critical dimension more slowly. This allows longer inspection intervals to be used, thus reducing aircraft operating cost. Alternatively, the applied stress could be raised while keeping the same inspection interval, thereby reducing aircraft weight.

The following examples illustrate various aspects of the invention and are not intended to limit the scope of the invention.

EXAMPLE 1

Five Al—Cu—Mg based alloys with varying amounts of Li having compositions as listed in Table 2 were cast as ingots.

TABLE 2

| | Measured Compositions of Cast Ingots | | | | | | | |
|---|---|---|---|---|---|---|---|---|
| Alloy No. | Cu | Mg | Li | Ag | Mn | Zr | Si | Fe |
| 1 | 4.0 | 0.76 | — | 0.49 | 0.3 | 0.11 | 0.06 | 0.04 |
| 2 | 3.9 | 0.74 | 0.19 | 0.49 | 0.3 | 0.11 | 0.02 | 0.03 |
| 3 | 4.0 | 0.79 | 0.49 | 0.50 | 0.3 | 0.11 | 0.02 | 0.03 |
| 4 | 4.1 | 0.75 | 0.70 | 0.50 | 0.3 | 0.11 | 0.02 | 0.03 |
| 5 | 4.1 | 0.78 | 1.20 | 0.50 | 0.3 | 0.11 | 0.02 | 0.03 |

The ingots listed in Table 2 were then fabricated into plate and sheet. Based on calorimetric analyses, the ingots were homogenized as follows. For alloys 1, 2 and 3: the ingots were heated at 50° F./hr to 905° F. (16 hours), then soaked at 905° F. for 4 hours, then heated in 2 hours to 970° F. and soaked for 24 hours. Finally, the ingots were air cooled to room temperature. For alloys 4 and 5: the ingots were heated at 50° F./hour to 905° F. (16 hours), soaked at 905° F. for 8 hours, then heated in 2 hours to 940° F. and soaked for 48 hours prior to air cooled to room temperature.

All ingots were the heated to 940° F., and hot rolled at about 900° F. Re-heats at 940° F. were provided to keep the metal temperature above 750° F. Rolling parameters were controlled to provide about a 0.5 inch bite reductions. Plate product with 0.7 inch and 0.5 inch gauges was fabricated. In addition, sheet product was hot rolled to a 0.10 inch gauge.

For alloys 1, 2 and 3, samples were solution heat treated (SHT) at a temperature of 970 F. Plate pieces were SHT for 2 hours. Sheet samples got a soak of only 1 hour. For alloys 4 and 5, samples were solution heat treated at a temperature of 940° F. Plate pieces were SHT for 2 hours. Sheet samples got a soak of only 1 hour.

All samples were quenched in water at room temperature and stretched 4% prior to aging to reach a T3 temper. All samples were aged at 310° F. for 24 hours to reach a T8-type temper.

Figure 2:
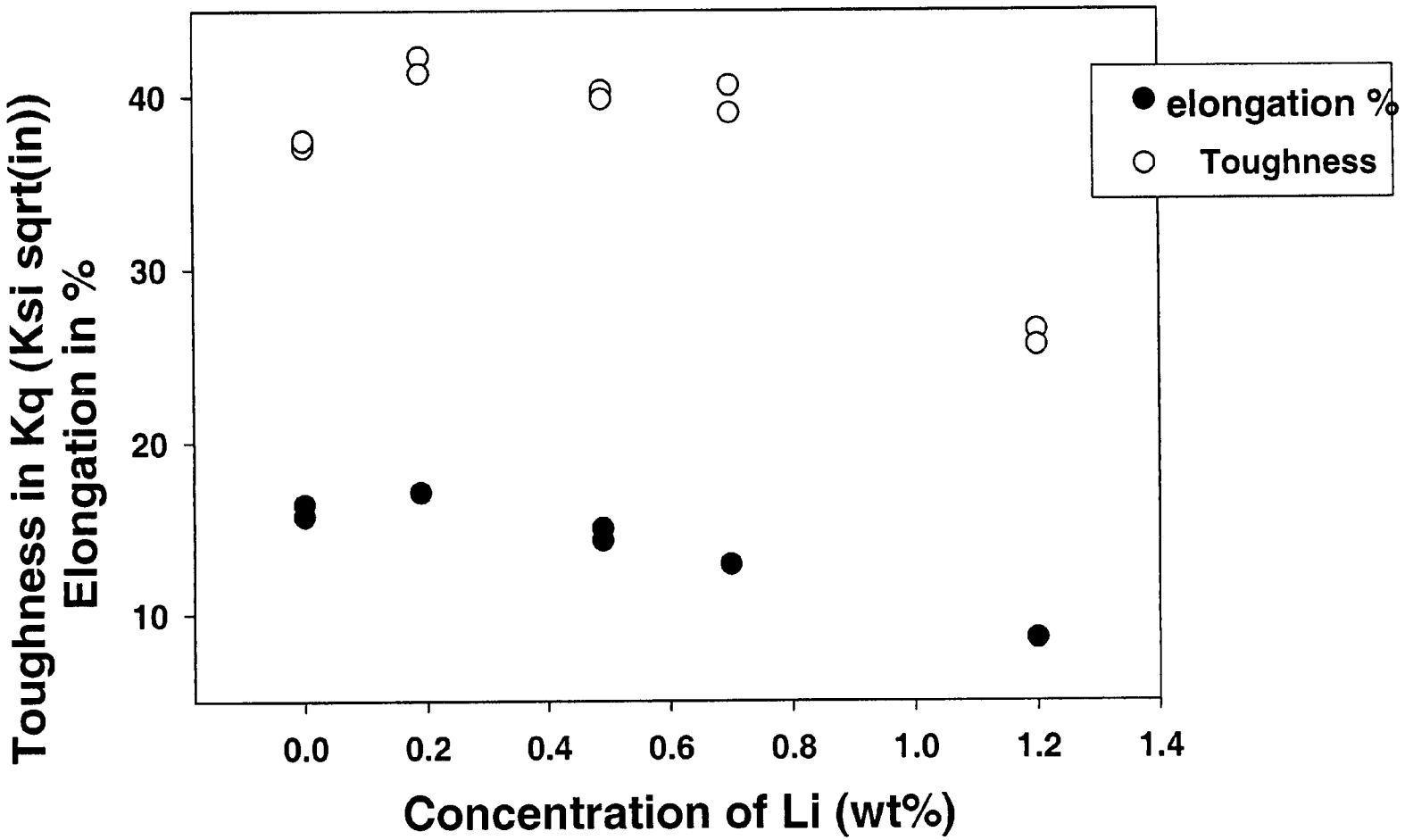
FIG. 2 is a graph of fracture toughness ($K_Q$) and elongation properties versus lithium content for Al—Cu—Mg based alloys in the form of plate products having varying amounts of Li.
Figure 3:
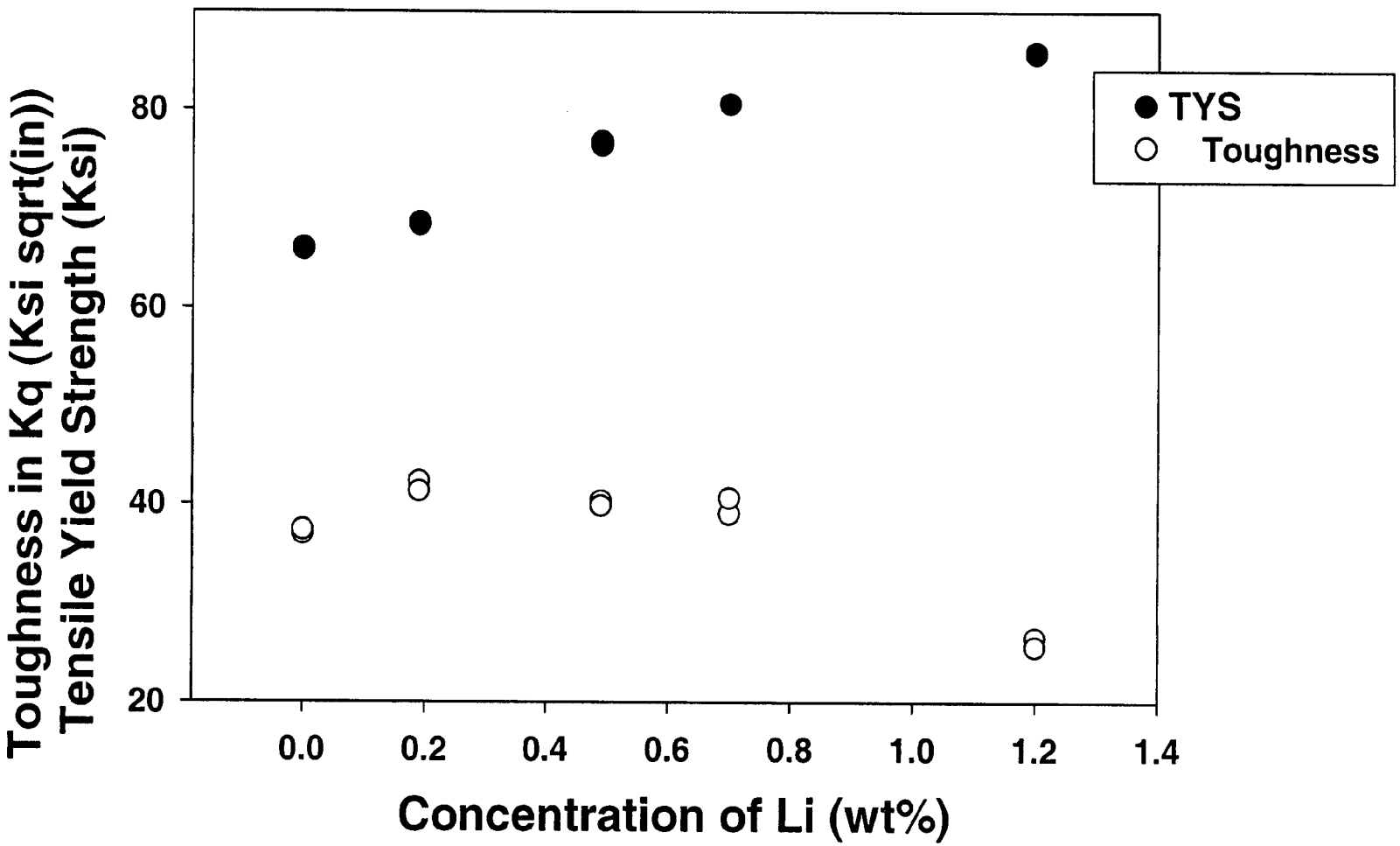
FIG. 3 is a graph of fracture toughness ($K_Q$) and tensile yield strength properties versus lithium content for Al—Cu—Mg based alloys in the form of plate products having varying amounts of Li.

Fracture toughness ($K_{Ic}$ or $K_Q$), ultimate tensile strength, tensile yield strength and elongation (4D) of the 0.5 inch gauge plate were measured. Tensile tests were performed in the longitudinal direction in accordance with ASTM B 557 "Standard Test Methods of Tension Testing of Wrought and Cast Aluminum and Magnesium-Alloy Products" on round specimens 0.350 inch in diameter. Fracture toughness was measured in the L-T orientation in accordance with ASTM E399-90 "Standard Test Method for Plane Strain Fracture Toughness of Metallic Materials" supplemented by ASTM B645-02 "Standard Practice for Plane Strain Fracture Toughness of Aluminum Alloys." The test specimens used were of full plate thickness and the W dimension was 1.0 inch. The results are listed in Table 3 and shown in FIGS. 2 and 3. Only the test results from Alloy 5 satisfied the validity requirements in ASTM E399-90 for a valid $K_{Ic}$. The test results from Alloys 1-4 failed to meet the following validity criteria: (1) $B \geqq 2.5 (K_Q/\sigma_{ys})^2$; (2) $a \geqq 2.5 (K_Q/\sigma_{ys})^2$; and (3) $P_{max}/P_Q \leqq 1.1$, where B, $K_Q$, $\sigma_{ys}$, $P_{max}$, and $P_Q$ are as defined in ASTM E399-90. The remaining validity criteria were all met. Test results not meeting the validity criteria are designated $K_Q$, the designation $K_{Ic}$ being reserved for test results meeting all the validity criteria. Failure to satisfy the above three criteria indicates that the specimen thickness was insufficient to achieve linear-elastic, plane-strain conditions as defined in ASTM E399. Those skilled in the art will appreciate that the higher the toughness or the lower the yield strength of the product the greater the thickness and width required to satisfy the above three criteria and achieve a valid result, $K_{Ic}$. The specimen thickness in these tests was necessarily limited by the plate thickness. A valid $K_{Ic}$ is generally considered a material property relatively independent of specimen size and geometry. Those skilled in the art will appreciate that $K_Q$ values, while they may provide a useful measure of material fracture toughness as in this case, can vary significantly with specimen size and geometry. Therefore, in comparing $K_Q$ values from different alloys it is imperative that the comparison be made on the basis of a common specimen size as was done in these tests. $K_Q$ values from specimens of insufficient thickness and width to meet the above validity criteria are typically lower than a valid $K_{Ic}$ coming from a larger specimen.

TABLE 3

Measured Properties from Plate

| Alloy No. | Li amount (wt %) | TYS (ksi) | UTS (ksi) | Elongation (%) | Toughness-$K_Q$ (ksi √in) |
|---|---|---|---|---|---|
| 1 | 0 | 66.1 | 70.3 | 15.7 | 37 |
| 1 | 0 | 65.9 | 70.1 | 16.4 | 37.4 |
| 2 | 0.19 | 68.6 | 72.4 | 17.1 | 42.3 |
| 2 | 0.19 | 68.4 | 72.4 | 17.1 | 41.3 |
| 3 | 0.49 | 76.4 | 79.6 | 15 | 40.3 |
| 3 | 0.49 | 76.8 | 79.7 | 14.3 | 39.8 |
| 4 | 0.70 | 80.6 | 84.5 | 12.9 | 39 |
| 4 | 0.70 | 80.6 | 84.4 | 12.9 | 40.6 |
| 5 | 1.20 | 85.9 | 90 | 8.6 | 26.5 ($K_{Ic}$) |
| 5 | 1.20 | 85.7 | 89.9 | 8.6 | 25.6 |

Fracture toughness ($K_c$ and $K_{app}$) in the L-T orientation and tensile yield strength in the L orientation were measured for 0.150 inch gauge sheet. The tests were performed in accordance with ASTM E561-98 "Standard Practice for R-Curve Determination" supplemented by ASTM B646-97 "Standard Practice for Fracture Toughness Testing of Aluminum Alloys". The test specimen was a middle-cracked tension M(T) specimen of full sheet thickness having a width of 16 inches, an overall length of 44 inches with approximately 38 inches between the grips, and an initial crack length, $2a_o$, of 4 inches. $K_c$ was calculated in accordance with ASTM B646 and $K_{app}$ in accordance with Mil-Hdbk-5J, "Metallic Materials and Elements for Aerospace Structural Vehicles." The results are shown in Table 4 and FIG. 4. It is recognized in the art that $K_{app}$ and $K_c$, for alloys having high fracture toughness, typically increases as specimen width increases or specimen thickness decreases. $K_{app}$ and $K_c$ are also influenced by initial crack length, $2a_o$, and specimen geometry. Thus $K_{app}$ and $K_c$ values from different alloys can only be reliably compared from test specimens of equivalent geometry, width, thickness and initial crack length as was done in these tests. While the toughness improvements observed in the invention alloys (Alloys 2-4) correspond to a test specimen of the type and dimensions noted, it is expected that similar improvements will be observed in other types and sizes of test specimens, although the values of $K_{app}$ and $K_c$ and the absolute magnitude of the numerical differences may vary for the reasons just stated.

TABLE 4

Measured Properties from Sheet: L orientation

| Alloy No. | Li Amount (wt %) | TYS (ksi) | Toughness - $K_{app}$ (ksi√in) | Toughness-$K_c$ (ksi√in) |
|---|---|---|---|---|
| 1 | 0 | 63 | 122 | 172 |
| 2 | 0.19 | 69 | 128 | 184 |
| 3 | 0.49 | 77 | 131 | 183 |
| 4 | 0.70 | 80 | 131 | 185 |
| 5 | 1.20 | 90 | 87 | 97 |

Figure 4:
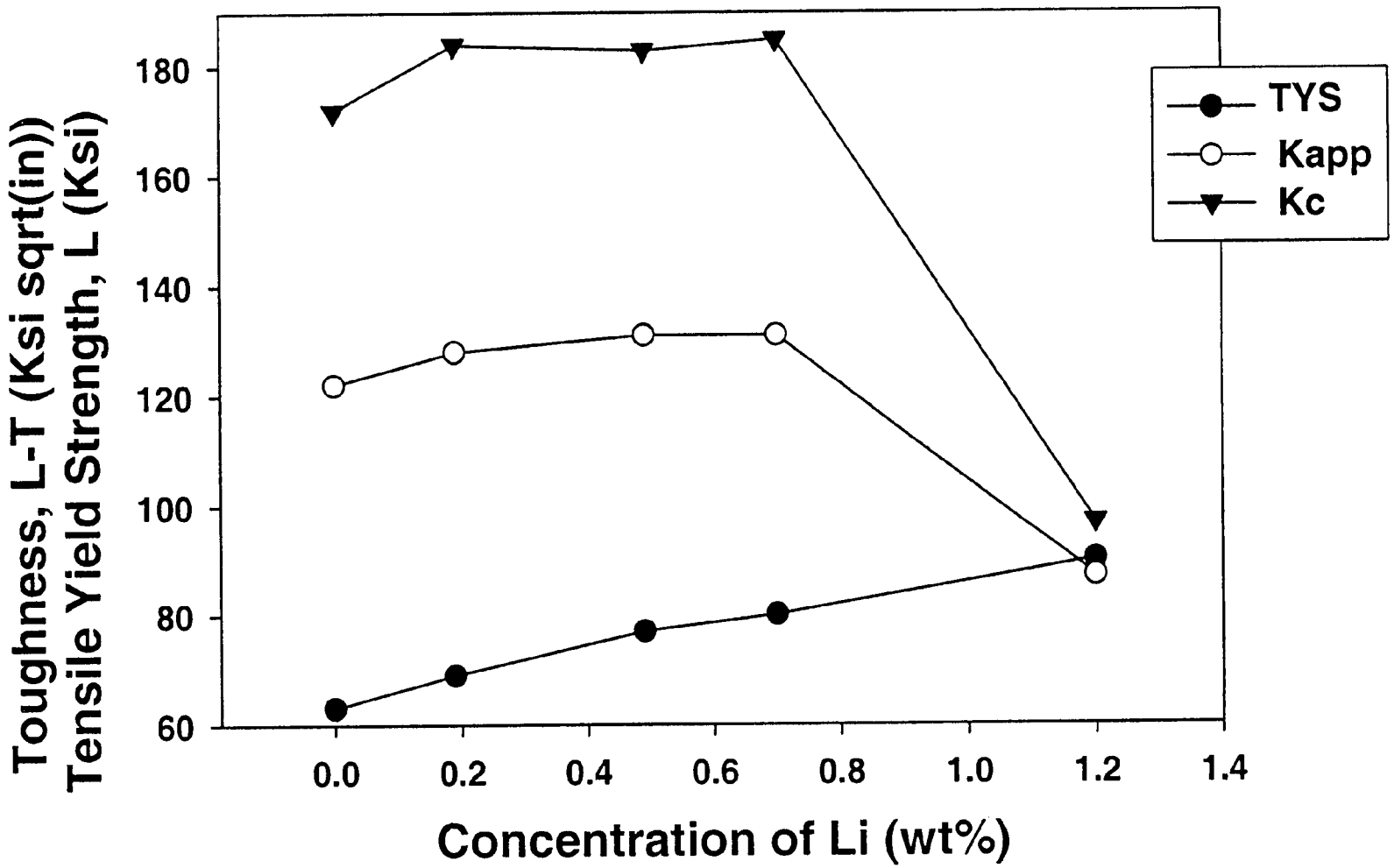
FIG. 4 is a graph of fracture toughness ($K_c$ and $K_{app}$) and tensile yield strength properties versus lithium content for Al—Cu—Mg based alloys in the form of sheet products having varying amounts of Li.
Figure 5:
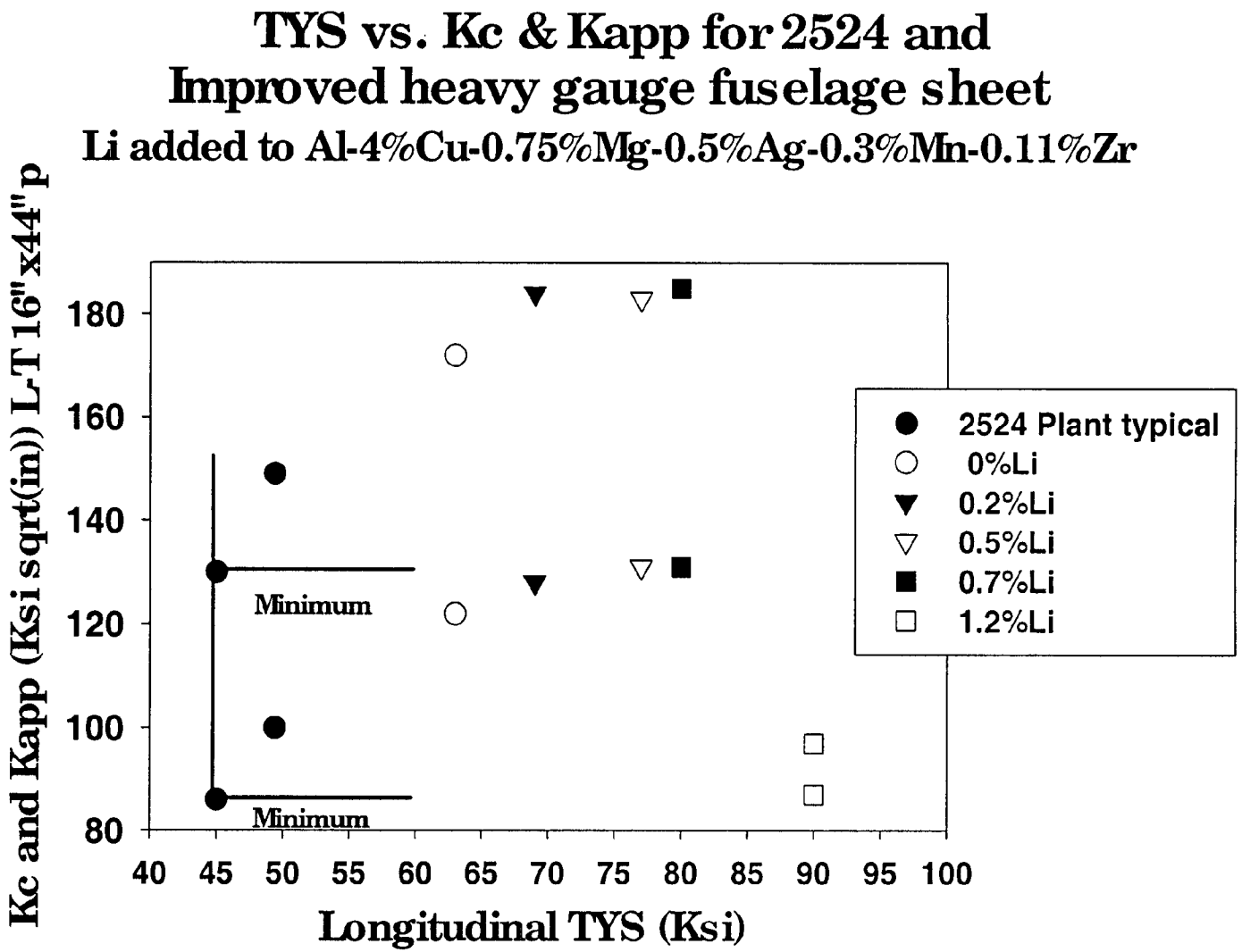
FIG. 5 is a plot of the fracture toughness and tensile yield strength values shown in FIG. 4 in comparison with plant typical and minimum fracture toughness and yield strength values for conventional alloy 2524 sheet.

FIG. 5 is a graph plotting the fracture toughness and longitudinal tensile yield strength values shown in FIG. 4 against plant typical and minimum values for conventional alloy 2524 sheet under similar conditions.

As shown in FIGS. 2-5, the Al—Cu—Mg based alloys of the present invention having Li additions of from 0.2 to 0.7 weight percent possess significantly improved fracture toughness in comparison with similar alloys containing either no Li or a greater amount of Li. In addition, the alloys of the present invention having relatively low levels of lithium achieve significantly improved combinations of fracture toughness and strength.

EXAMPLE 2

An ingot of an aluminum-copper-magnesium alloy having the following composition was cast (remainder is aluminum and incidental impurities):

INGOT NO. 1

| Si | Fe | Cu | Mn | Mg | Zn | Zr |
|---|---|---|---|---|---|---|
| 0.03 | 0.03 | 3.24 | 0.58 | 1.32 | 0 | 0.11 |

Material fabricated from this ingot is designated Alloy A.

After this, the remaining molten metal was re-alloyed (i.e., alloying again an alloy already made) by adding 0.25% lithium to create a target addition of 0.25 weight percent lithium. A second ingot was then cast having the following composition (remainder is aluminum and incidental impurities):

INGOT NO. 2

| Li | Si | Fe | Cu | Mn | Mg | Zn | Zr |
|---|---|---|---|---|---|---|---|
| 0.19 | 0.03 | 0.04 | 3.41 | 0.61 | 1.28 | 0 | 0.1 |

Material fabricated from this ingot will be designated Alloy B hereinafter in this example.

Ingot No. 3 was created by re-alloying the remaining molten metal after casting Ingot No. 2 and then adding another 0.25 weight percent lithium to create a total target addition of 0.50 weight percent lithium. Ingot No. 3 had the following composition (remainder is aluminum and incidental impurities):

| INGOT NO. 3 | | | | | | | |
|---|---|---|---|---|---|---|---|
| Li | Si | Fe | Cu | Mn | Mg | Zn | Zr |
| 0.35 | 0.04 | 0.04 | 3.37 | 0.6 | 1.2 | 0 | 0.11 |

Material fabricated from this ingot will be designated Alloy C hereinafter in this example.

Ingot No. 4 was created by re-alloying the remaining molten metal after casting Ingot No. 3 and then adding another 0.26 weight percent lithium to create a total target addition of 0.75 weight percent lithium. A fourth ingot was cast having the following composition (remainder is aluminum and incidental impurities):

| INGOT NO. 4 | | | | | | | |
|---|---|---|---|---|---|---|---|
| Li | Si | Fe | Cu | Mn | Mg | Zn | Zr |
| 0.74 | 0.02 | 0.03 | 3.34 | 0.56 | 1.35 | 0.01 | 0.12 |

Material fabricated from this ingot will be designated Alloy D hereinafter in this example.

The four ingots were stress relieved and homogenized. The ingots were then subjected to a standard presoak treatment after which the ingots were machine scalped. The scalped ingots were then hot rolled into four (4) separate 0.7 inch gauge plates using hot rolling practices typical of 2XXX alloys.

Figure 6:
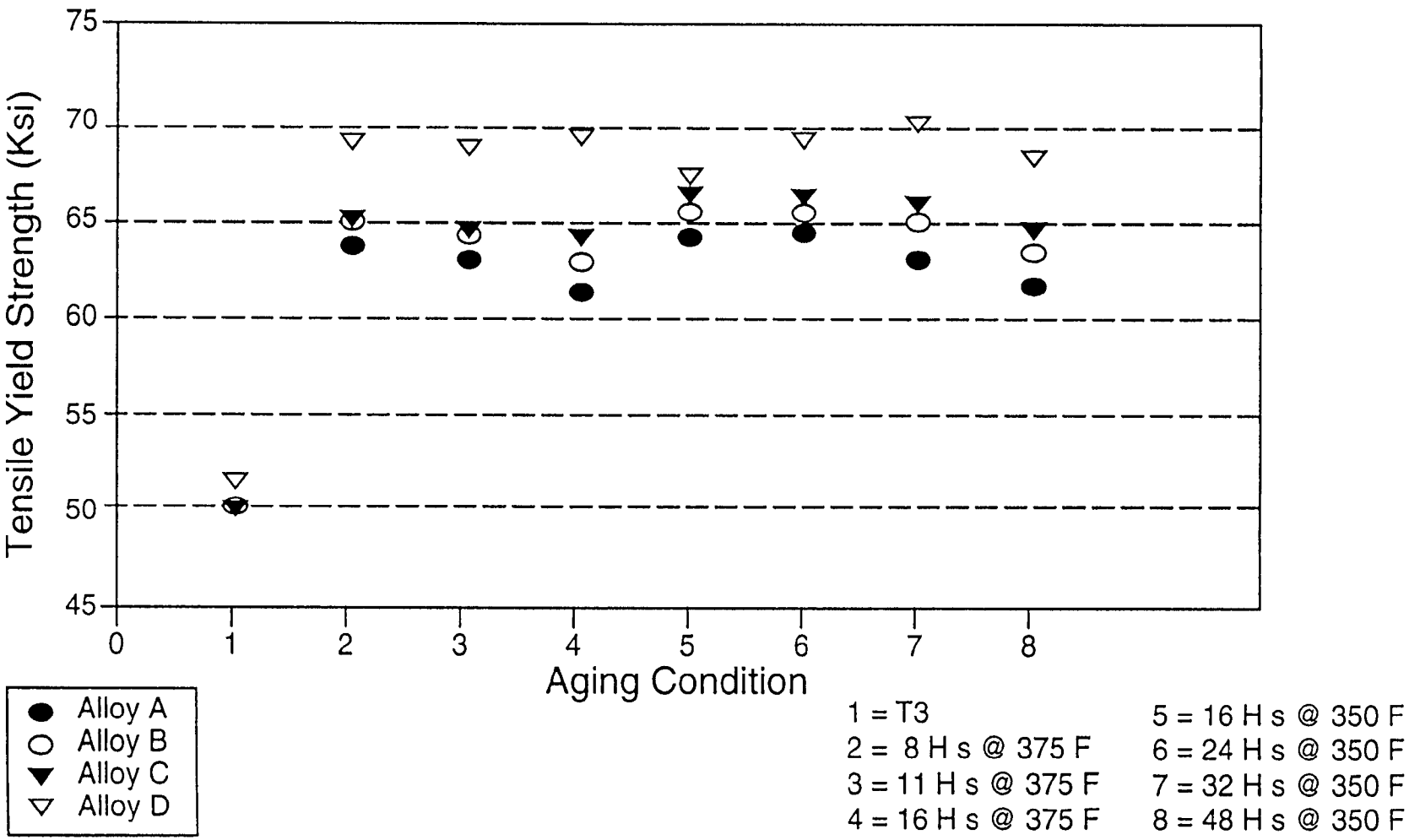
FIG. 6 is a chart showing the tensile yield strength of various specimens made from Al—Cu—Mg alloys with various amounts of Li designated Alloy A, Alloy B, Alloy C, and Alloy D after being subjected to different aging conditions.

After the four separate plates were produced, a section of each of the plates was removed. Each of the four sections were (a) solution heat treated; (b) quenched; and (c) stretched 1.5%. After this, eight tensile strength test samples were produced from each of the treated four (4) sections, making a total of thirty-two tensile strength test samples. One tensile strength test sample from each group of eight (there being a total of four plates in each group) was each subject to eight different aging conditions, as described in the legend of FIG. 6. After this, tensile yield strength tests were performed, with the results being shown in FIG. 6. It will be seen that the alloys having lithium additions exhibited greater strength than those without lithium, which at the same time exhibiting thermal stability.

After this, the remainder of three of the four plates (i.e., Ingot No. 1 plate, Ingot No. 3 plate and Ingot No. 4 plate) was each cut into thirds, to form pieces 1, 2 and 3 for each plate, or a total of 9 pieces. Piece 1 of all three plates were (a) solution heat treated; (b) quenched; (c) stretched 1½%; and (d) aged to T8 temper by aging it 24 @ 350° F. These pieces were designated Alloy A-T8, Alloy C-T8; and Alloy D-T8. Piece 2 of all three plates were (a) solution heat treated; (b) quenched; (c) stretched 1½%; and (d) naturally aged to T3 temper. These pieces were designated Alloy A-T3; Alloy C-T3; and Alloy D-T3. Finally, Piece 3 of all three plates were (a) solution heat treated; (b) quenched; (c) cold rolled 9%; (d) stretched 1½%; and (e) naturally aged. These pieces were designated Alloy A-T39; Alloy C-T39; and Alloy D-T39. It was these pieces which provided the material for all of the further testing which will be reported herein.

Figure 7:
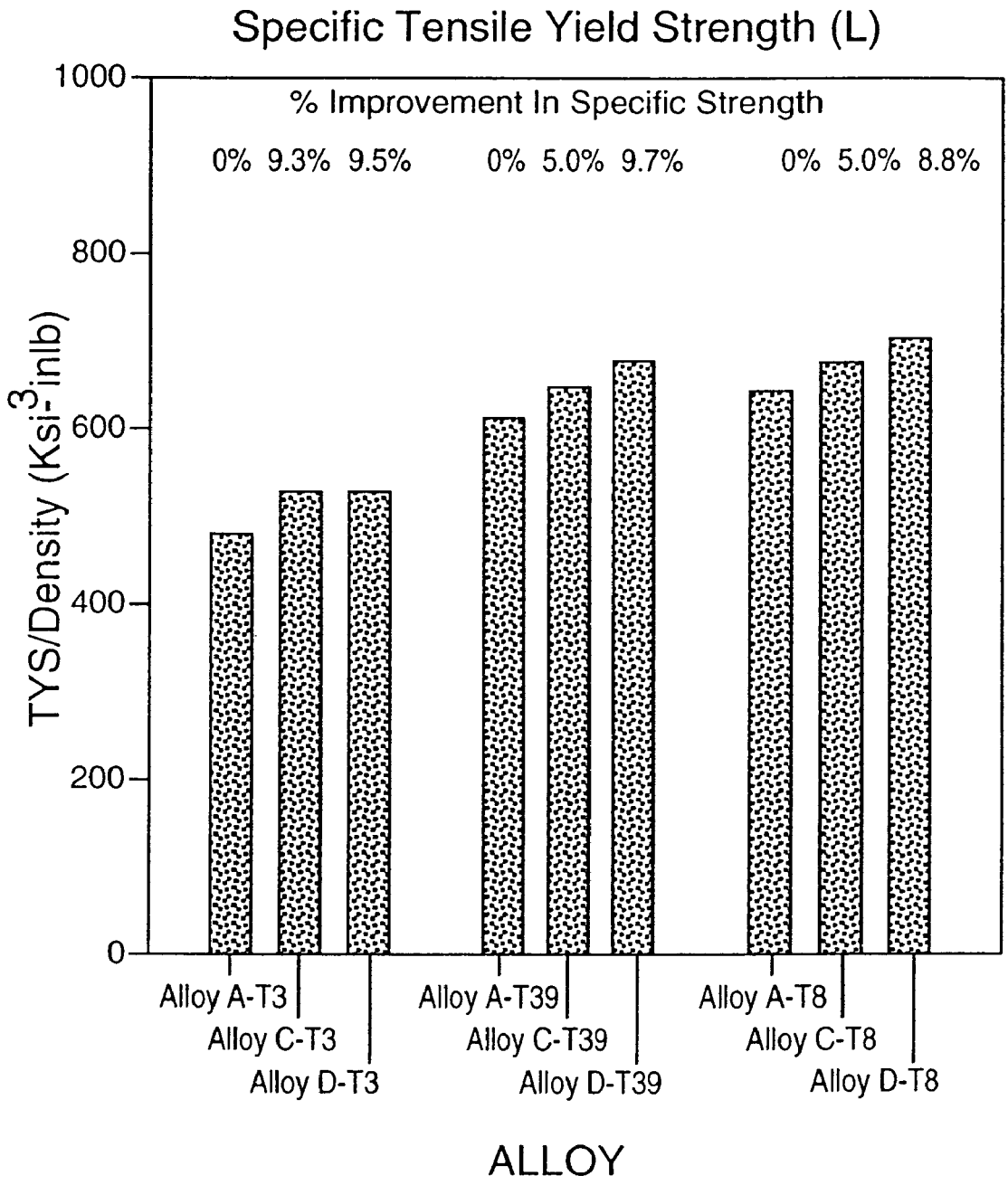
FIG. 7 is a bar graph showing the improvement in specific strength for some of the specimens shown in FIG. 6.

Referring now to FIG. 7, the tensile yield strength divided by density for a testing portion of each of the nine pieces produced above is shown. It can be seen that improvements in the tensile yield strength to density ratio were found for ancillary lithium additions.

Figure 8:
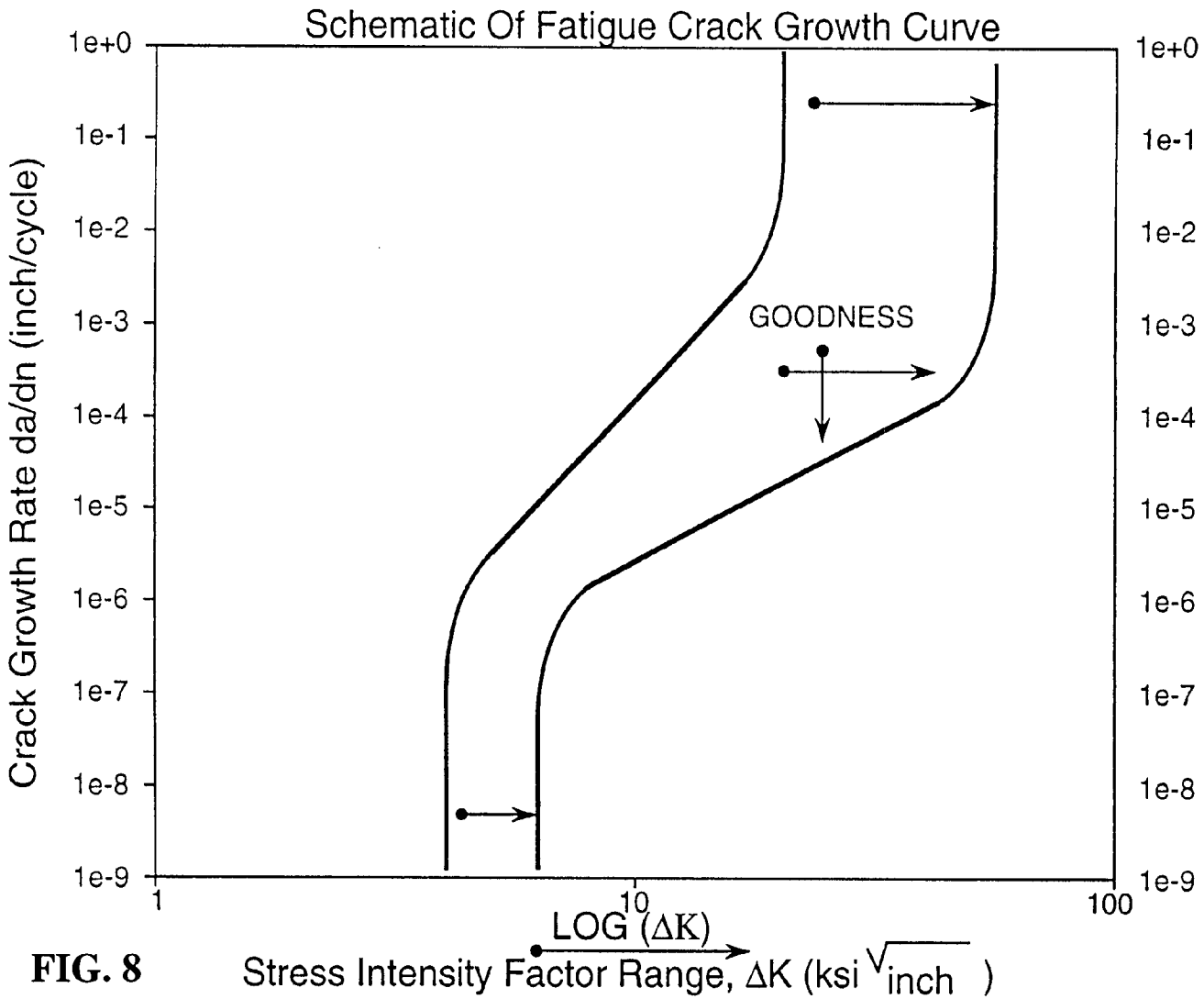
FIG. 8 is a graph showing the typical representation of fatigue crack growth rate, da/dN (in/cycle) and how it changes.

Referring now to FIGS. 8-12, the key property of fatigue crack growth resistance will now be discussed. FIG. 8 is a graph showing the typical representation of fatigue crack growth performance and how improvements therein can be shown. The x-axis of the graph shows the applied driving force for fatigue crack propagation in terms of the stress intensity factor range, ΔK, which is a function of applied stress, crack length and part geometry. The y-axis of the graph shows the material's resistance to the applied driving force and is given in terms of the rate at which a crack propagates, da/dN in inch/cycle. Both ΔK and da/dN are presented on logarithmic scales as is customary. Each curve represents a different alloy with the alloy having the curve to the right exhibiting improved fatigue crack growth resistance with respect to the alloy having the curve to the left. This is because the alloy having the curve to the right exhibits a slower crack propagation rate for a given ΔK which represents the driving force for crack propagation. Fatigue crack growth testing of all alloys in the L-T orientation was performed in accordance with ASTM E647-95a "Standard Test Method for Measurement of Fatigue Crack Growth Rates". The test specimen was a middle-cracked tension M(T) specimen having a width of 4 inches and a thickness of 0.25 inch. The tests were performed in controlled high humidity air having a relative humidity greater than 90% at a frequency of 25 Hz. The initial value of the stress intensity factor range, ΔK, in these tests was about 6 ksi$\sqrt{\text{in}}$ and the tests were terminated at a ΔK of about 20 ksi$\sqrt{\text{in}}$.

Figure 9:
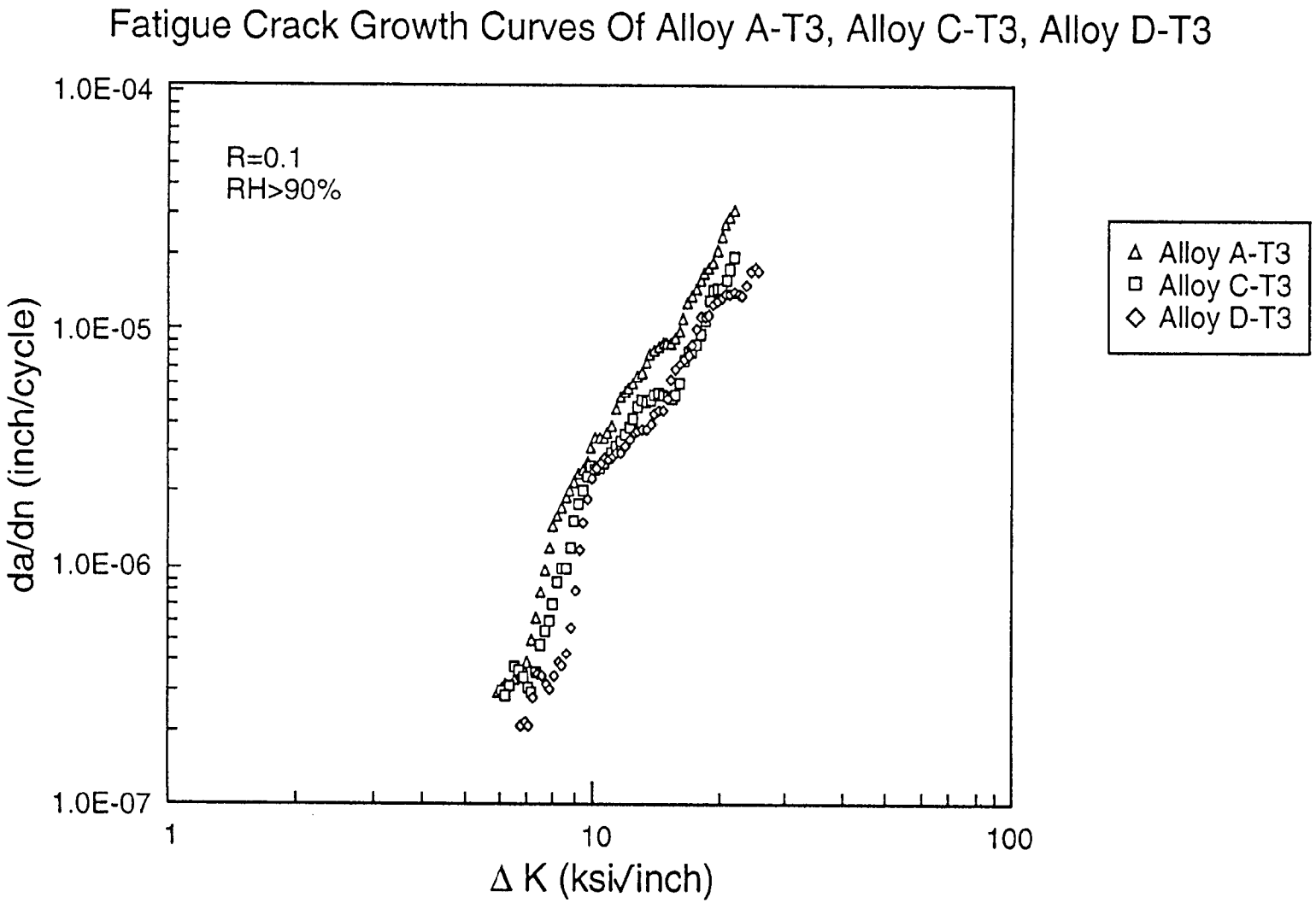
FIG. 9 is a graph showing the fatigue crack growth curves for Alloy A-T3 plate; Alloy C-T3 plate; and Alloy D-T3 plate.
Figure 10:
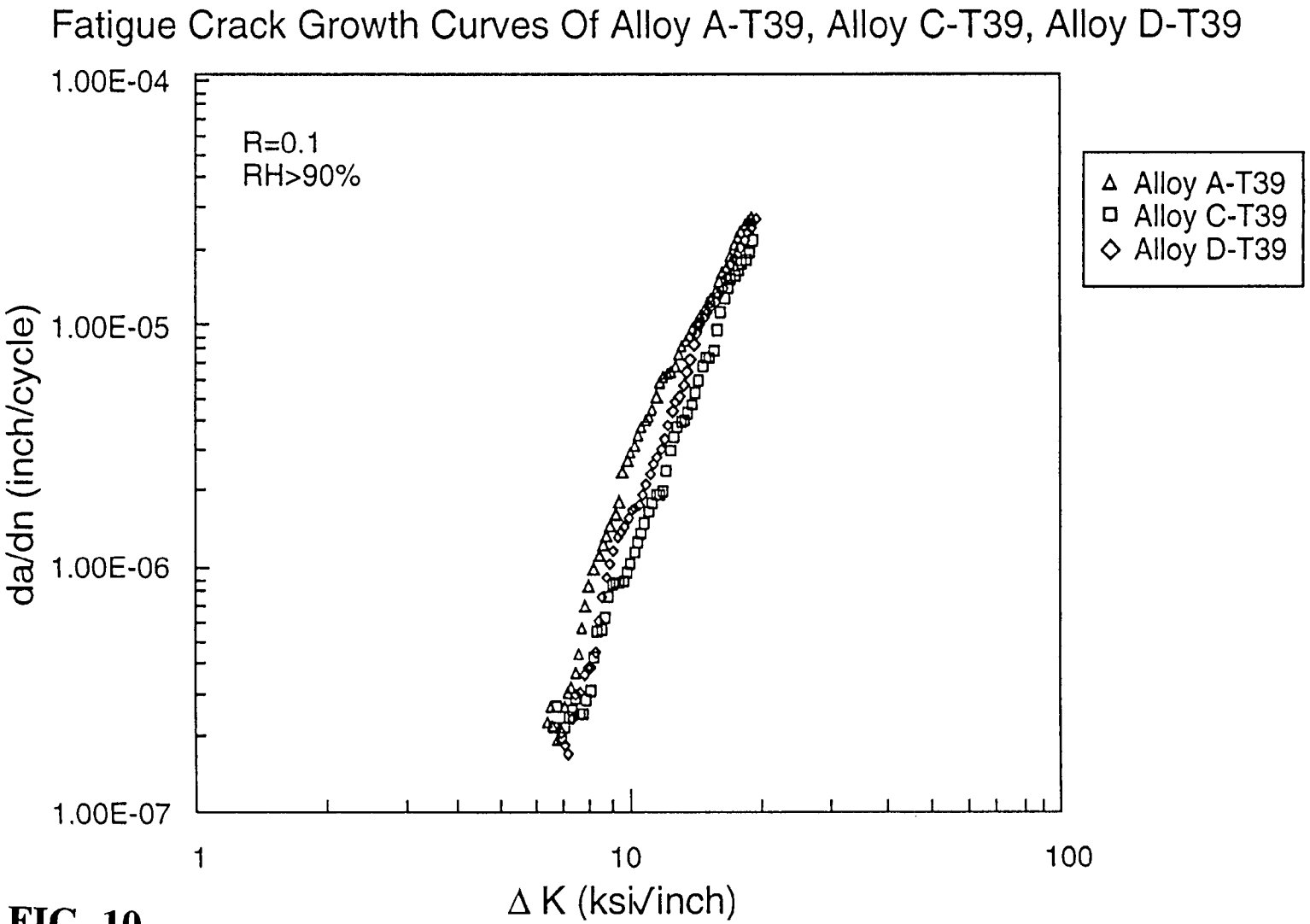
FIG. 10 is a graph showing the fatigue crack growth curves for Alloy A-T39 plate; Alloy C-T39 plate; and Alloy D-T39 plate.
Figure 11:
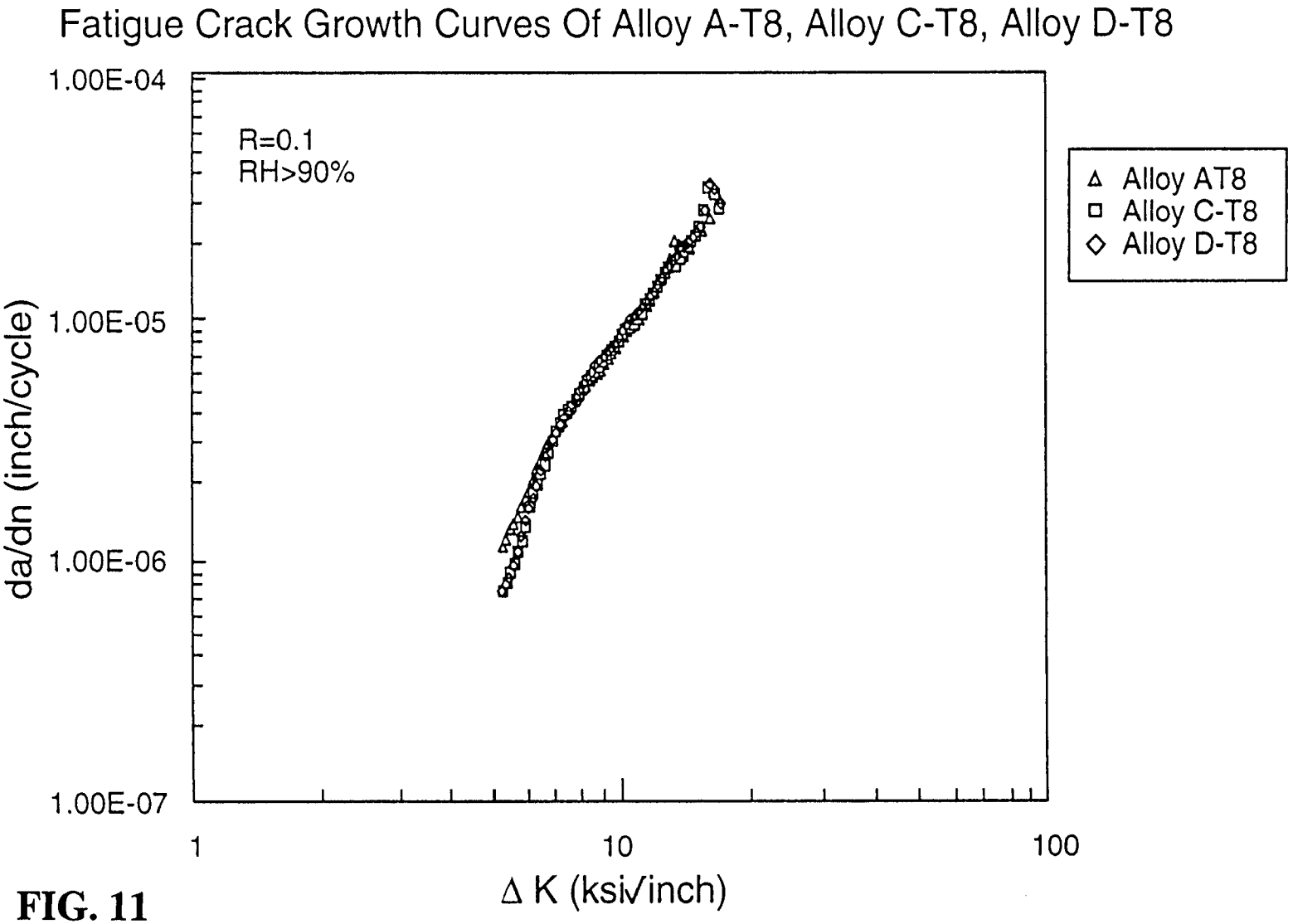
FIG. 11 is a graph showing the fatigue growth curves for Alloy A-T8 plate; Alloy C-T8 plate; and Alloy D-T8 plate.
Figure 12:
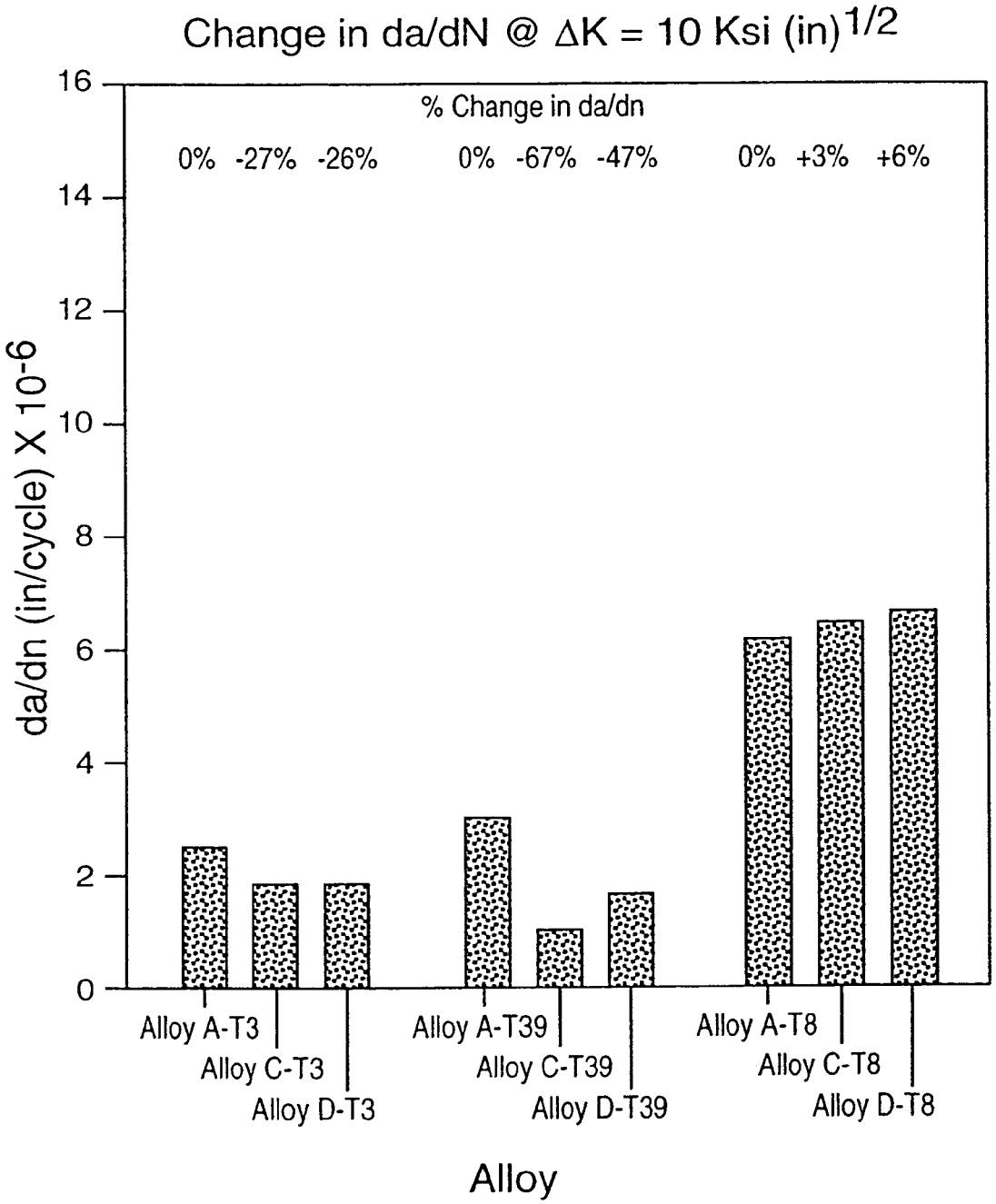
FIG. 12 is a bar graph showing the percentage change in da/dN at $\Delta K=10$ Ksi $(in)^{1/2}$.

Turning to FIGS. 9-11, it can be seen, that based on the criteria discussed with respect to FIG. 8, the addition of lithium substantially increases the fatigue crack growth resistance in the respective alloys in the T3 and T39 conditions. The fatigue crack rates for crack driving forces of ΔK equal to 10 ksi$\sqrt{\text{in}}$ are summarized in FIG. 12. The percentage improvement in fatigue crack growth resistance (i.e., percentage reduction in fatigue crack growth rates) is given at the top of the graph. Alloy C-T3 and Alloy D-T3 show improvements of 27% and 26%, respectively over Alloy A-T3 (no lithium additions). The percentage improvements in fatigue crack growth resistance of Alloy C-T39 and Alloy C-T39 over Alloy A-T39 (no lithium additions) was 67% and 47%, respectively. Those skilled in the art will appreciate that fatigue crack growth rates may be significantly influenced by humidity level and frequency in moist air environments as a result of an environmental contribution to fatigue crack growth. Thus, while the fatigue crack growth improvements exhibited by the invention alloys correspond to the specific humidity and frequency noted, it is expected that similar improvements will be observed under other testing conditions.

With regard to the T8 alloys, it can be seen that the lithium additions do not improve the fatigue crack growth resistance. In the case of artificially aged alloys, aged to peak strength, the only advantage of lithium additions is in terms of additional strength and lower density.

Figure 13:
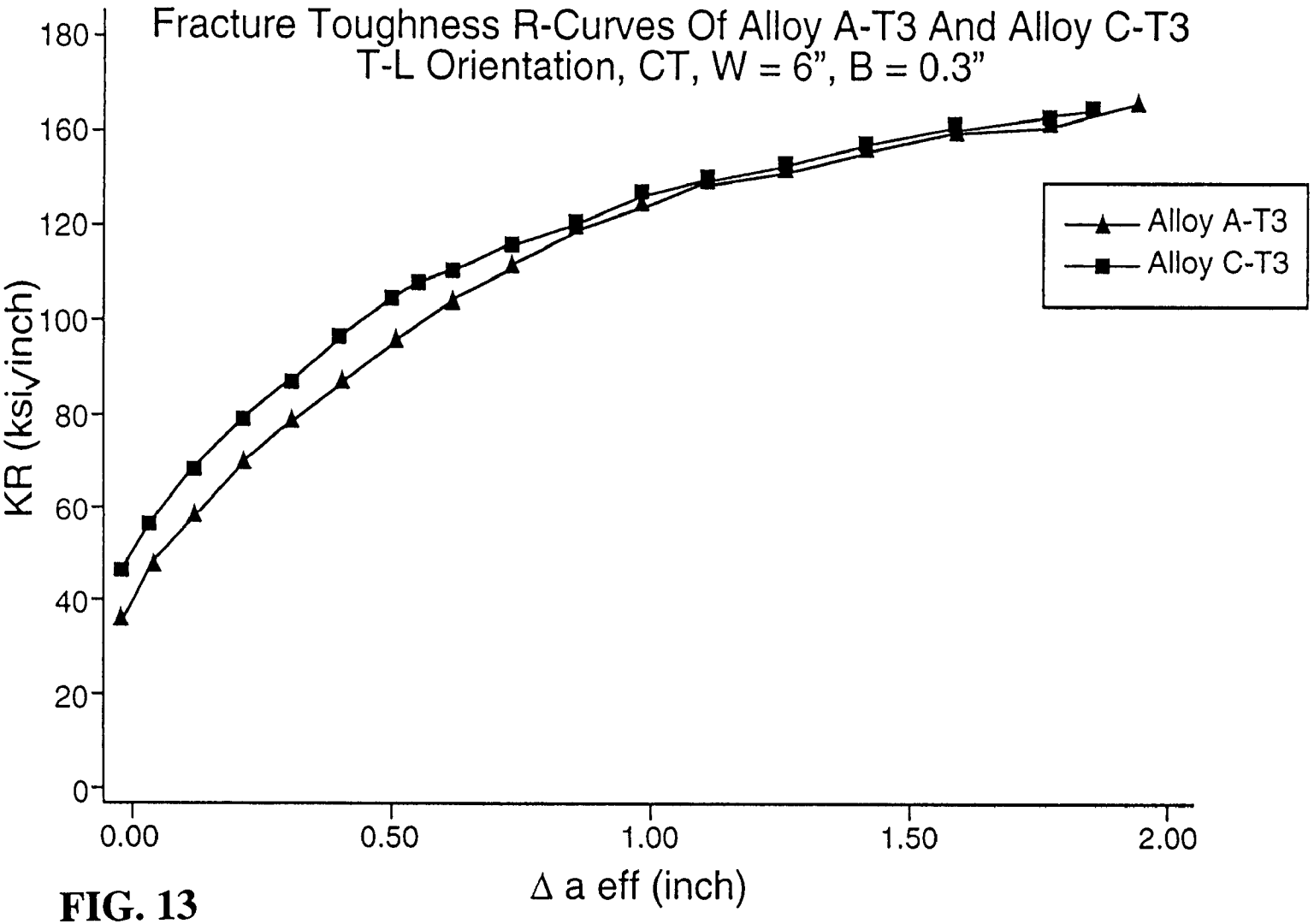
FIG. 13 is a graph showing the fracture toughness R-curves of Alloy A-T3 and Alloy C-T3.
Figure 14:
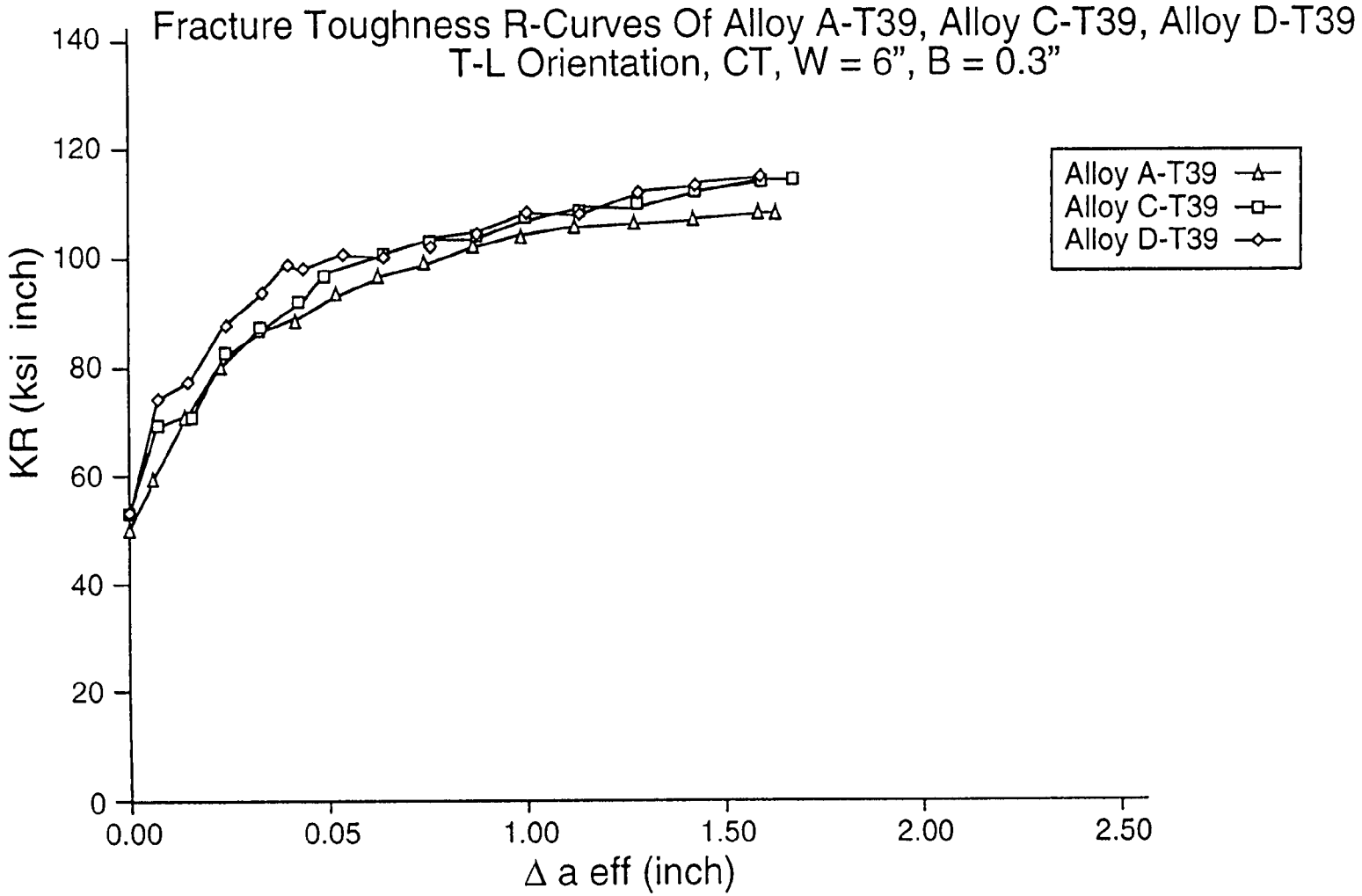
FIG. 14 is a graph showing the fracture toughness R-curves for Alloy A-T39, Alloy C-T39 and Alloy D-T39 plate.

FIGS. 13 and 14 show the fracture toughness R-curves for the T3 and T39 tempers, respectively, in the T-L orientation. The R-curve is a measure of resistance to fracture ($K_R$) versus stable crack extension (Δaeff). In addition, Table 5 shows single-point measurements of fracture toughness for Alloys A, C and D in the T3, T39 and T8 tempers in terms of $K_{R25}$, which is the crack extension of resistance, $K_R$, on the R-curve corresponding to the 25% secant offset of the test record of load versus crack-opening displacement (COD), and $K_Q$, which is the crack extension resistance correspondence to the 5% secant offset of the test record of load versus COD. $K_{R25}$ is an appropriate measure of fracture toughness for moderate strength, high toughness alloy/tempers such as T3 and T39, which $K_Q$ is appropriate for higher strength, lower toughness alloy/tempers such as T8. The R-curve tests were performed in accordance with ASTM E561-98 "Standard Practice for R-Curve Determination" The test specimen was a compact-tension C(T) specimen having a W dimension of 6 inches, a thickness of 0.3 inches and an initial crack length, $a_o$, of 2.1 inches. The $K_{R25}$ value was determined from these same tests in accordance with ASTM B646-94 "Standard Practice for Fracture Toughness Testing of Aluminum Alloys". Those skilled in the art will appreciate that $K_{R25}$ values, like $K_c$ and $K_{app}$, depend on specimen width, thickness and initial crack length and that reliable comparisons between alloys can only be made on test specimens of equivalent dimensions. Plane strain fracture toughness testing was performed in the L-T T orientaion in accordance with ASTM E399-90 supplemented by ASTM B645-95. The test specimens used had a thickness of 0.65 inch and the W dimension was 1.5 inches. The results did not satisfy one or more of the following validity criteria: $B \geqq 2.5 (K_Q/\sigma_{ys})^2$; (2) $a \geqq 2.5 (K_Q/\sigma_{ys})^2$; and (3) $P_{max}/P_Q < 1.1$, where B, $K_Q$, $\sigma_{ys}$, $P_{max}$, and $P_Q$ are as defined in ASTM E399-90. The previous discussion regarding $K_Q$ values which are invalid by the the above criteria is also applicable to these results.

TABLE 5

Strength and Toughness Measurements
(Tensile Longitudinal Properties - Toughness Orientation L-T or T-L)

| Alloy/Temper | TYS (ksi) | UTS (ksi) | Elongation (%) | $K_Q$, L-T (ksi√in) | $K_{R25}$, T-L (ksi √in) |
|---|---|---|---|---|---|
| Alloy A-T3 | 47.7 | 65.6 | 18.6 | — | 97.9 |
| Alloy C-T3 | 51.4 | 69.8 | 17.1 | — | 107.8 |
| Alloy D-T3 | 51.1 | 70.6 | 17.5 | — | not tested |
| Alloy A-T39 | 61.2 | 67.3 | 11.4 | — | 88.8 |
| Alloy C-T39 | 63.3 | 70.7 | 9.3 | — | 91.5 |
| Alloy D-T39 | 65.7 | 70.5 | 9.9 | — | 97.5 |
| Alloy A-T8 | 63.7 | 69.7 | 12.1 | 32.4 | — |
| Alloy C-T8 | 65.9 | 71.9 | 11.7 | 38.7 | — |
| Alloy D-T8 | 67.8 | 73.8 | 10.7 | 38.9 | — |

It will be appreciated that fracture toughness is significantly improved by the low levels of lithium additions in accordance with the present invention, in comparison with similar alloys having either no lithium or greater amounts of lithium. Furthermore, the lithium additions of the present invention yield improved toughness at higher strength levels. Therefore, the combination of fracture toughness and strength is significantly improved. This is unexpected because lithium additions are known to decrease fracture toughness in conventional aluminum-copper-magnesium-lithium alloys.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An aluminum alloy comprising:
from about 3 to about 4.5 weight percent Cu,
from greater than 0.6 to about 2 weight percent Mg,
from about 0.01 to about 0.8 weight percent Li,
up to about 2.0 weight percent Zn,
up to about 2.0 weight percent Ag,
up to about 1 weight percent of a dispersoid, and
the balance aluminum and incidental elements and impurities,
Wherein the amount of Cu in the alloy is below the maximum solubility;
Wherein the amount of Mg in the alloy is below the maximum solubility; and
Wherein the fracture toughness and strength of the alloy are both increased when increasing lithium from about 0.01 to about 0.8 weight percent.

2. The aluminum ahoy of claim 1, wherein the Li content of the alloy is from about 0.2 to about 0.8 weight percent.

3. The aluminum alloy of claim 1, wherein the Li content of the alloy is from about 0.2 to about 0.7 weight percent.

4. The aluminum alloy of claim 1, wherein the Cu content of the alloy is from about 3.5 to about 4.5 weight percent.

5. The aluminum alloy of claim 1, wherein the Cu content of the alloy is from about 3.6 to about 4.4 weight percent.

6. The aluminum alloy of claim 1, wherein the Mg content of the ahoy is from about 0.6 to about 1.5 weight percent.

7. The aluminum alloy of claim 1, wherein the Mg content of the alloy is from about 0.7 to about 1.0 weight percent.

8. The aluminum alloy of claim 1, wherein the Cu and Mg contents of the alloy conform to the formula:

$$Cu \leqq 2-0.676\ (Mg-6).$$

9. The aluminum alloy of claim 1, wherein the Cu and Mg contents of the alloy conform to the formula:

$$Cu \leqq 1.5-0.556\ (Mg-6).$$

10. The aluminum alloy of claim 1, wherein the Ag content of the alloy is from about 0.01 to about 2 weight percent.

11. The aluminum alloy of claim 10, wherein the Ag content of the alloy is from about 0.05 to about 0.5 weight percent.

12. The aluminum alloy of claim 10, wherein the Ag content of the alloy is from about 0.1 to about 0.4 weight percent.

13. The aluminum alloy of claim 1, wherein the Zn content of the alloy is from about 0.05 to about 2 weight percent.

14. The aluminum alloy of claim 13, wherein the Zn content of the alloy is from about 0.2 to about 1 weight percent.

15. The aluminum alloy of claim 13, wherein the Zn content of the alloy is about 0.5 weight percent.

16. The aluminum alloy of claim 1, further comprising from about 0.1 to about 2 weight percent Si.

17. The aluminum alloy of claim 1, wherein said dispersoid is selected from at least one of the group consisting of chromium, vanadium, titanium, zirconium, manganese, nickel, iron, hafnium, and scandium.

18. The aluminum alloy of claim 17, wherein the at least one dispersoid in the alloy is present in a total amount up to about 1.0 weight percent of the alloy.

19. The aluminum alloy of claim 1, the alloy further comprising from about 0 to about 0.6 weight percent Mn.

20. The aluminum alloy of claim 1, wherein the aluminum alloy is in the form of a plate.

* * * * *

UNITED STATES PATENT AND TRADEMARK OFFICE

CERTIFICATE OF CORRECTION

PATENT NO. : 7,438,772 B2
APPLICATION NO. : 10/678290
DATED : October 31, 2008
INVENTOR(S) : Roberto J. Rioja, Gary H. Bray and Paul E. Magnusen It is certified that error appears in the above-identified patent and that said Letters Patent is hereby corrected as shown below:

Column 12, lines 18-19, cancel the text of claim 2 and insert the following claim:

--2. The aluminum alloy of claim 1, wherein the Li content of the alloy is from about 0.2 to about 0.8 weight percent.

Signed and Sealed this

Twenty-fourth Day of February, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,438,772 B2
APPLICATION NO. : 10/678290
DATED : October 21, 2008
INVENTOR(S) : Roberto J. Rioja, Gary H. Bray and Paul E. Magnusen It is certified that error appears in the above-identified patent and that said Letters Patent is hereby corrected as shown below:

Column 12, lines 18-19, cancel the text of claim 2 and insert the following claim:

--2. The aluminum alloy of claim 1, wherein the Li content of the alloy is from about 0.2 to about 0.8 weight percent.

This certificate supersedes the Certificate of Correction issued February 24, 2009.

Signed and Sealed this

Seventeenth Day of March, 2009

JOHN DOLL
*Acting Director of the United States Patent and Trademark Office*